US008834193B2

(12) United States Patent
Li et al.

(10) Patent No.: US 8,834,193 B2
(45) Date of Patent: Sep. 16, 2014

(54) ELECTRICAL CONNECTOR WITH ELASTIC LOCKING MECHANISM AND ELECTRICAL CONNECTOR ASSEMBLY THEREOF

(75) Inventors: Chun-Sheng Li, Kunshan (CN); Jun Wang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 103 days.

(21) Appl. No.: 13/589,092

(22) Filed: Aug. 18, 2012

(65) Prior Publication Data

US 2013/0045620 A1 Feb. 21, 2013

(51) Int. Cl.

| | |
|---|---|
| ***H01R 4/50*** | (2006.01) |
| ***H01R 13/625*** | (2006.01) |
| ***H01R 13/627*** | (2006.01) |
| *H01R 13/24* | (2006.01) |

(52) U.S. Cl.

CPC ..... *H01R 13/6275* (2013.01); *H01R 13/2428* (2013.01)

USPC ..... 439/345; 439/357

(58) Field of Classification Search

USPC ..... 439/345, 327, 350, 357, 322, 349, 355

See application file for complete search history.

(56) References Cited

U.S. PATENT DOCUMENTS

| | | | | |
|---|---|---|---|---|
| 5,791,932 | A * | 8/1998 | Hasenfratz | 439/347 |
| 6,869,301 | B2 * | 3/2005 | Shimizu et al. | 439/324 |
| 2012/0322292 | A1 * | 12/2012 | Li et al. | 439/345 |

FOREIGN PATENT DOCUMENTS

CN 201887241 Y 6/2011

* cited by examiner

*Primary Examiner* — Hae Moon Hyeon

(74) *Attorney, Agent, or Firm* — Wei Te Chung; Ming Chieh Chang

(57) ABSTRACT

An electrical connector (100) with a mating surround interface (A1) for mating with a mating electrical connector (600) includes an insulative housing (1), a plurality of contacts (2) retained in the insulative housing (1), an elastic locking member (4) and a positioning spacer (3) is mounted on the insulative housing (1). The electrical connector (100) also includes a receiving slit (103) defined between the insulative housing (1) and the positioning spacer (3). The elastic locking member (4) includes a body portion (41) mounted on the side wall (12) and a pair of moveable locking arms (42) integrally extending from both ends of the body portion (41) which are bended to a different plane and extend through the mating surround interface (A1).

19 Claims, 8 Drawing Sheets

ELECTRICAL CONNECTOR WITH ELASTIC LOCKING MECHANISM AND ELECTRICAL CONNECTOR ASSEMBLY THEREOF

BACKGROUND OF THE INVENTION

1. Field of the Invention

The present invention relates to an electrical connector and an electrical connector assembly thereof, and more particularly to an electrical connector and an electrical connector assembly thereof which have elastic locking mechanism creating an stably engagement between the electrical connector and a corresponding mating connector thereof.

2. Description of the Related Art

CN Pat. No. 201887241Y issued to Guo on Jun. 29, 2011, discloses an electrical connector assembly including a plug connector and a receptacle connector mating with each other for transmitting power signal. The receptacle connector has an insulative housing and a plurality of elastic contacts retained in the insulative housing. The plug connector includes a mating housing and a plurality of mating contacts retained in the mating housing. The contacts are arranged in a plurality of receiving grooves of the insulative housing in a longitudinal direction in which the insulative housing extends. Each of the elastic contacts defines a retaining portion retained in the insulative housing, an elastic contacting arm extending from one end of the retaining portion with a contacting portion extruding out of the receiving groove for electrically connecting with the plug contact and a soldering portion extending from another end of the retaining portion for soldering on a PCB. The elastic contacts are moveable and are pulled into the receiving grooves by the plug contacts when the plug contacts engage with the elastic contacts.

The insulative housing defines pairs of spring latches for locking with corresponding locking recesses formed by the mating housing. The spring latches and locking recess are interlocked to each other when the connectors are engaging with each other in a mating direction. However, the spring latches are integrally formed by the insulative housing, thereby easily being short of original elasticity or broken after repeatedly used. So the plug connector would be disengages with the electrical connector.

Therefore, an improved electrical connector and electrical connector assembly thereof are desired to overcome the disadvantages of the related arts.

SUMMARY OF THE INVENTION

An object of the present invention is to provide an electrical connector overcoming disadvantage of the locking mechanism which is formed by the insulative housing and accidently disengages with mating connector because of their non-normal condition such as being short of original elasticity or broken.

In order to achieve the above-mentioned object, an electrical connector in accordance with a preferred embodiment of the present invention includes an insulative housing, a plurality of contacts retained in the insulative housing, an elastic locking member and a positioning spacer is mounted on the insulative housing. The electrical connector also includes a receiving slit defined between the insulative housing and the positioning spacer. The elastic locking member includes a body portion mounted on the side wall and a pair of moveable locking arms integrally extending from both ends of the body portion which are bended to a different plane and extend through a mating surround interface defined by the electrical connector.

Other objects, advantages and novel features of the invention will become more apparent from the following detailed description of the present embodiment when taken in conjunction with the accompanying drawings.

DETAILED DESCRIPTION OF THE INVENTION

Figure 1:
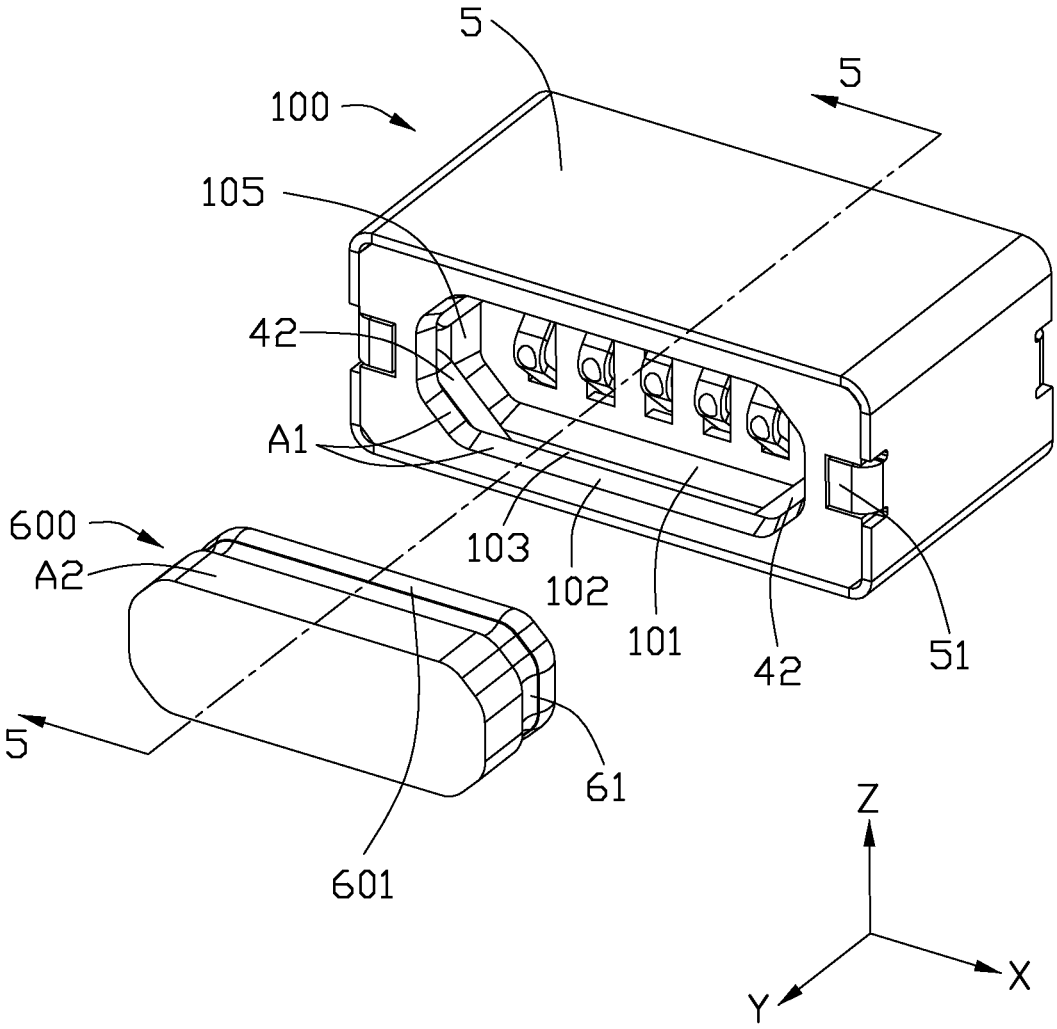
FIG. 1 is a perspective view of an electrical connector and a mating electrical connector disengaging with each other in accordance with the preferred embodiment of the present invention.

Reference will now be made to the drawing figures to describe the preferred embodiments of the present invention in detail.

Figure 2:
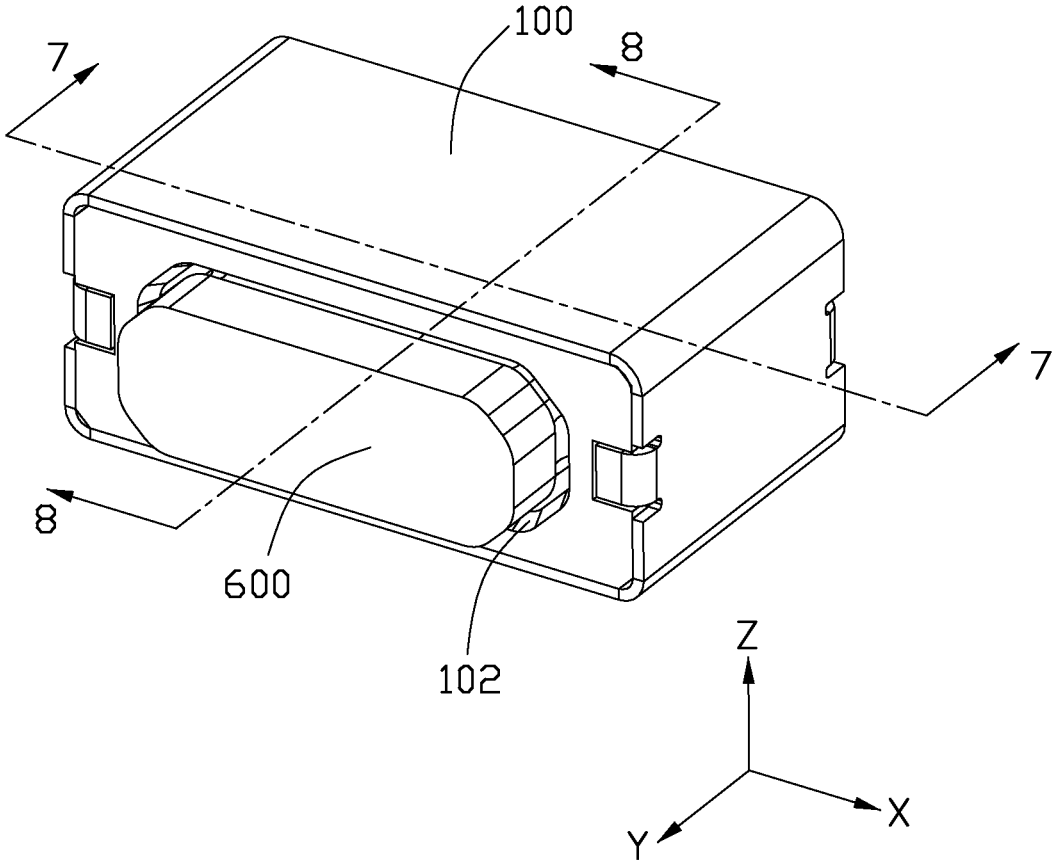
FIG. 2 is a perspective view of the pair electrical connectors engaging with each other of FIG. 1.

Referring to FIGS. 1 and 2, an electrical connector assembly includes an electrical connector 100 (i.e. a receptacle connector) and a mating electrical connector 600 (i.e. a plug connector) for engaging with the electrical connector 100. The electrical connector 100 defines a mating space 101 with an inserting opening 102 for receipting the mating electrical connector 600 inserted into thereof, thereby forming a pair of mating surround interfaces A1, A2 mating with each other, which are separately formed by an inner round surface 103 of the mating space 101 and an outer round surface 601 of the plug connector 600.

Figure 3:
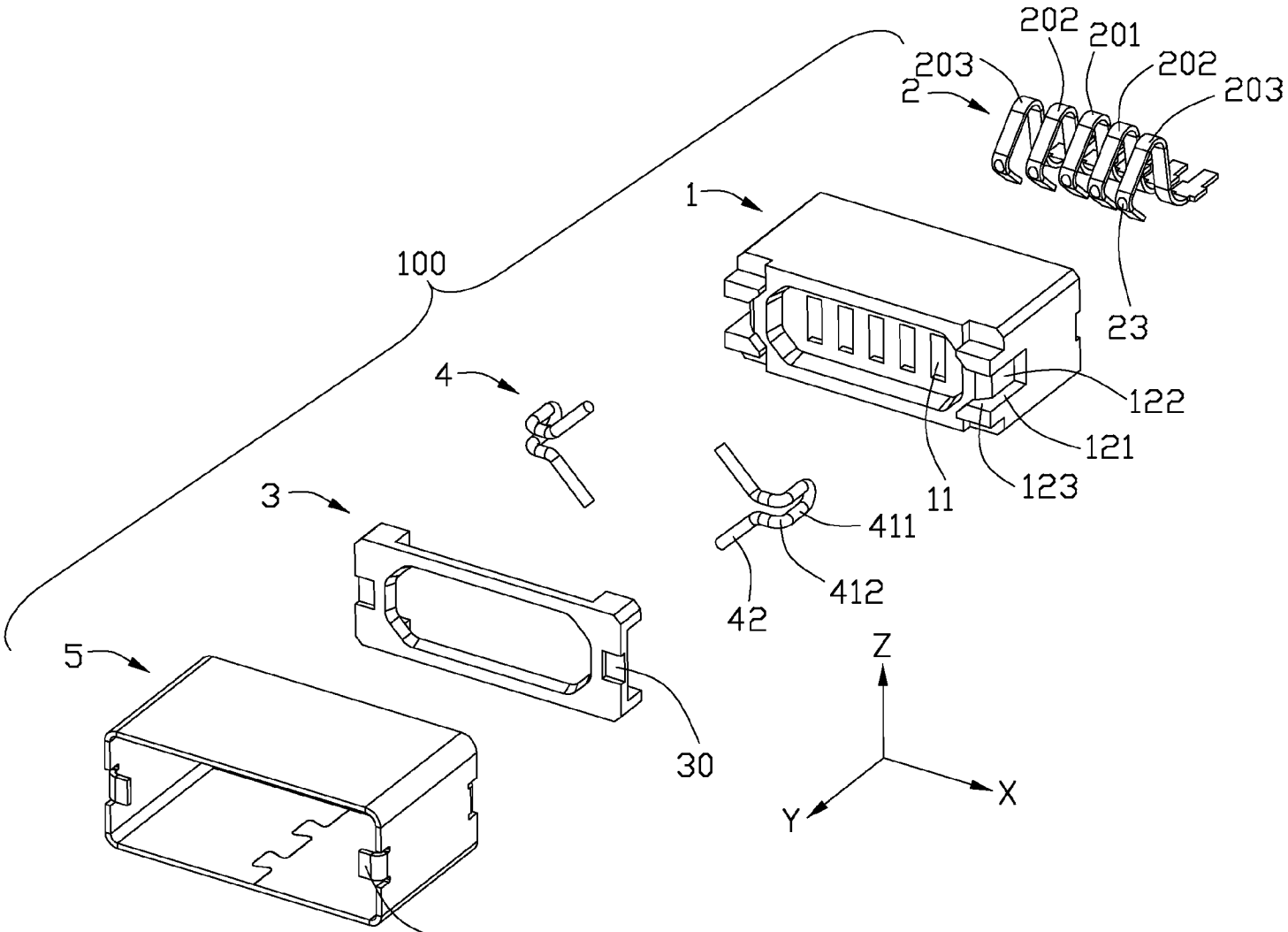
FIG. 3 is an exploded perspective view of the electrical connector of FIG. 1.
Figure 4:
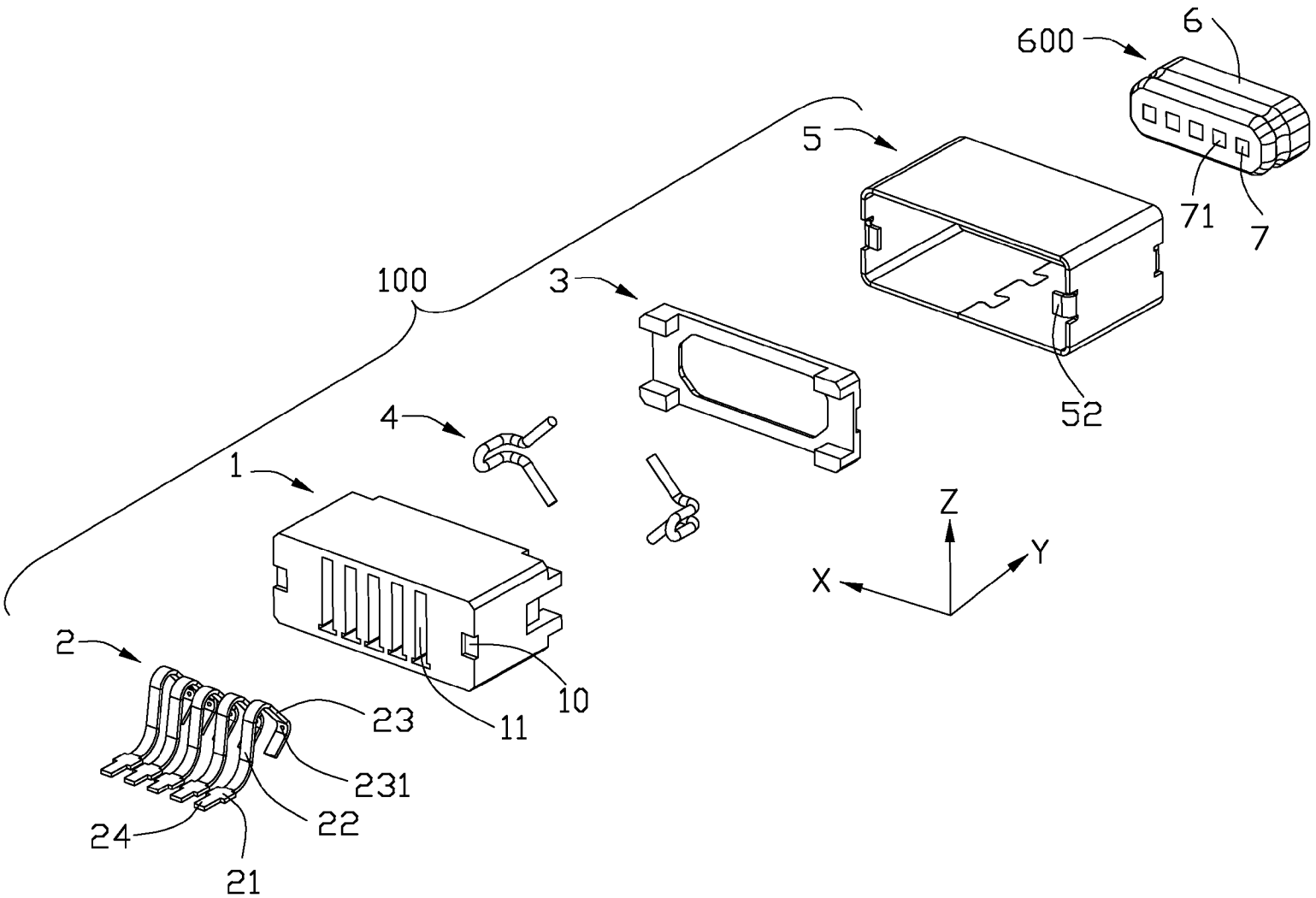
FIG. 4 is another exploded perspective view of the electrical connector of FIG. 1 while showing another perspective view of the mating electrical connector.
Figure 5:
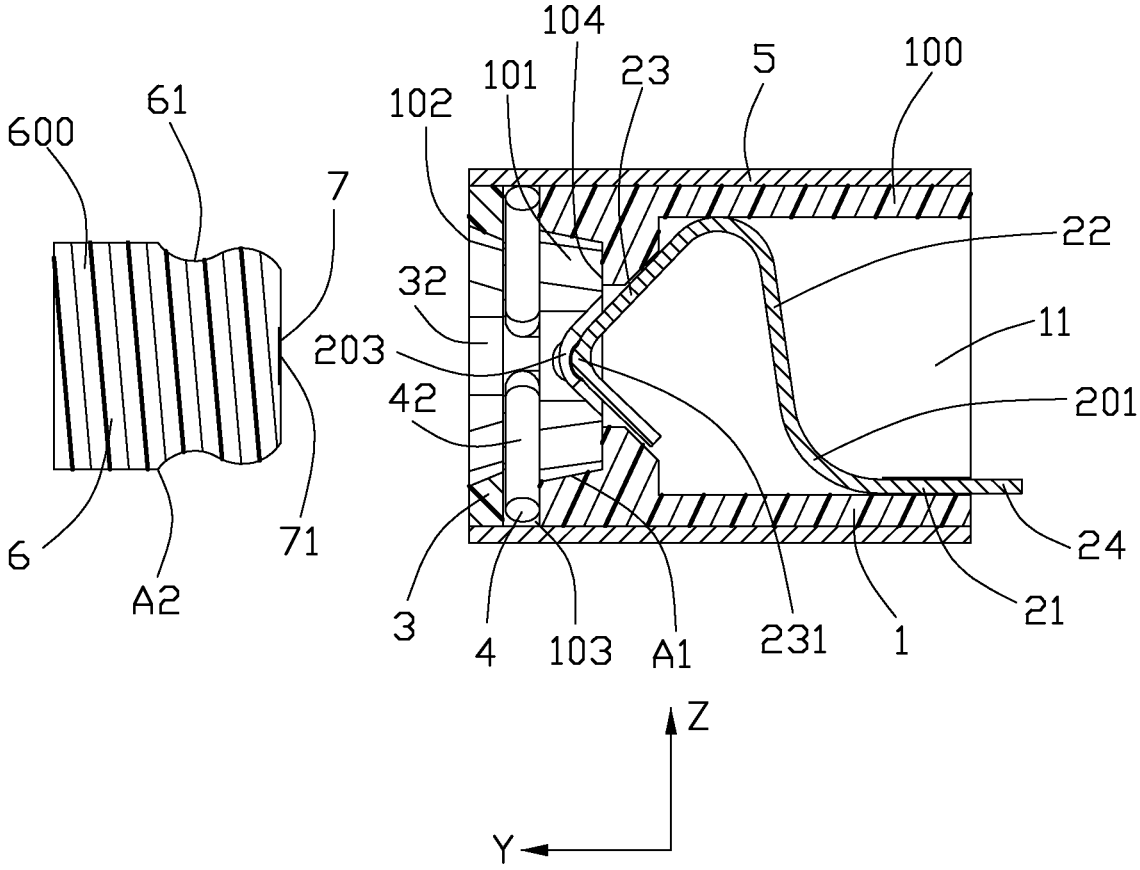
FIG. 5 is a cross-section view of the pair electrical connectors taken along line 5-5 of FIG. 1.

Referring to FIGS. 3 to 5, the electrical connector 100 includes an insulative housing 1, a plurality of contacts 2 arranged in the insulative housing 1 along a longitudinal direction (shown as arrow X), a positioning spacer 3 retained on the insulative housing 1, an elastic locking member 4 disposed between the insulative housing 1 and the positioning spacer 3, and a metallic shell 5 shielding outside of the insulative housing 1. The insulative housing 1 defines a mating face 104 disposed in front of the insulative housing 1. The mating electrical connector 600 includes a mating housing 6 and a plurality of mating contacts 7 retained in the mating housing 6. The mating contact 7 defines a flat mating contacting portion 71 for engaging with the contact 2.

The insulative housing 1 forms a plurality of receiving grooves 11 for receiving the contacts 2 which are inserted into thereof in a mating direction (shown as arrow Y) orthogonal to the X direction. The contacts 2 has five pins arranged one array in the X direction and includes a detect pin 201 in the middle, a pair of power pins 202 disposed at both sides of the detect pin 201 and a pair of grounding pins 203 disposed on the most out sides, in which the grounding pins 203 are located best outer side for establishing grounding function. The detect pin 201 is disposed on the most inside of the mating space 101 for detecting the power pins whether they conduct electricity or not. The metallic shell 5 defines a first tab 51 for locking a first notch 30 and a second tab 52 for locking a second notch 10, thereby assembling the insulative housing 1 and the positioning spacer 3 together and shielding out thereof.

Each of the contacts 2 includes a retaining portion 21 retained in the insulative housing 1, a forniciform connecting portion 22 (i.e. deflectable contacting section) extending from one end of the retaining portion 21, an elastic contacting arm 23 extending from the connecting portion 22 with a contacting portion 231 which is bended to be V-shaped configuration and protrude into the mating space 101 for electrically connecting with the mating contacting portion 71 and a soldering portion 24 extending from another end of the retaining portion 21 for soldering on a PCB (not shown).

Figure 6:
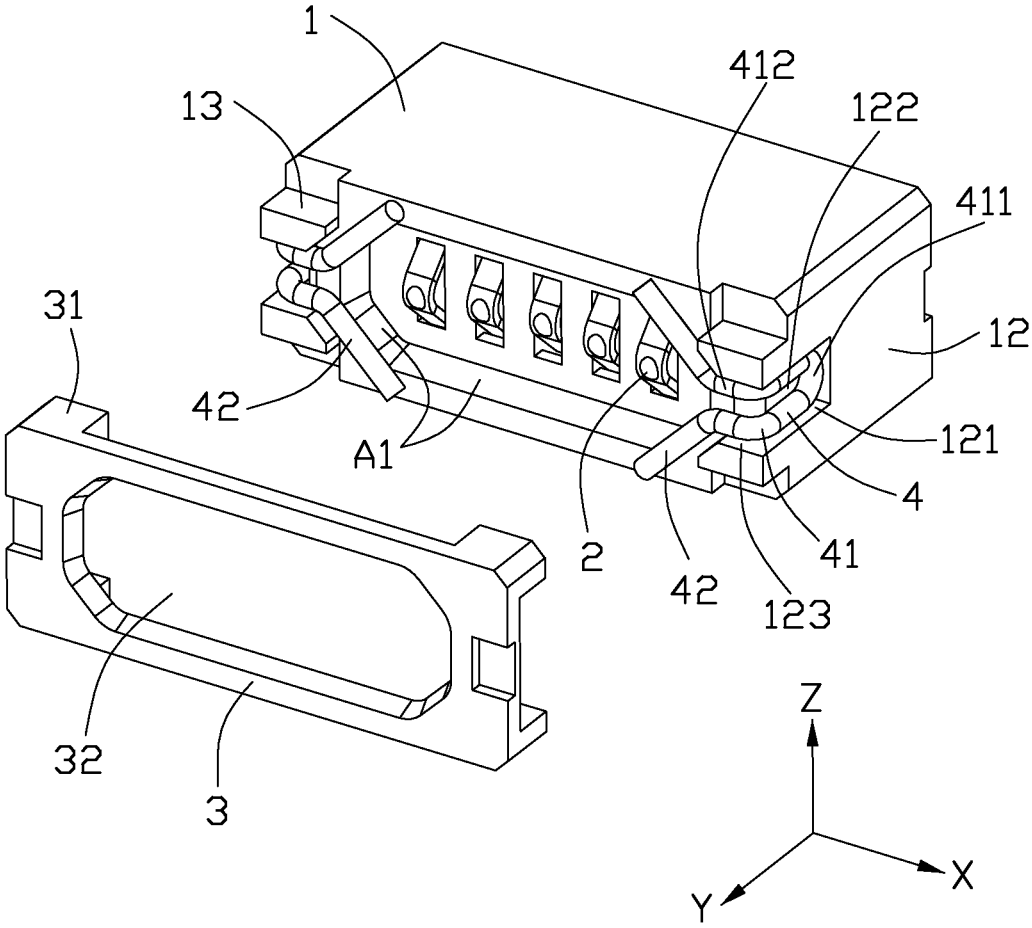
FIG. 6 is a partly exploded perspective view of the electrical connector of FIG. 1.

Referring to FIGS. 5 and 6, the elastic locking member 4 is bended to be an L-shaped configuration from a metal material stick (not shown) and forms a body portion 41 which is mounted on at least one side wall 12 defined by the insulative housing 1 in an inverse direction of the Y direction and is opposite to the side wall 12, and a pair of moveable locking arms 42 integrally extending from both ends of the body portion 41 and bended to a different plane, which extend through the mating surround interface A1 of the electrical connector 100 and partly protrude into the mating space 101 for locking the mating electrical connector 600. The positioning spacer 3 is mounted on the insulative housing along the inverse direction of the Y direction and defines a tuber 31 retained in a recess 13 formed by the insulative housing 1, thereby forming a receiving slit 103 between the insulative housing 1 and the positioning spacer 3 for permitting movement of the elastic locking member 4 therein. The positioning spacer 3 is manufactured of metal materials for improving hard-wearing ability and defines an inserting opening 32 in communicated with the mating space 101 for providing the mating electrical connector 600 inserting through.

Referring to FIGS. 1, 5, 7 and 8, the moveable locking arms 42 of each elastic locking member 4 are disposed round the mating space 101 and moves clockwise or counterclockwise, thereby forming a variable angle A which is open to the mating space 101. The mating space 101 defines chamfered structures 105 on corners, and the locking arm 42 complies with said chamfered structures in the Y direction. When the mating electrical connector 600 engages with the electrical connector 100, the locking arms 42 move to a second position in which the locking arm 42 is urged and moves into the receiving slit 103 in a vertical plane perpendicular to the Y direction for permitting the mating electrical connector 600 easily insertion, from a first position in which the locking arm 42 is in original state and partly protruded into the mating space 101. After the electrical connector assembly is engaged together, the locking arms 42 return to the original state (i.e. the first position) and lock in a recess area or groove 61 of the mating electrical connector 600 for stably locking the electrical connector assembly together. The elastic locking arms 42 of the elastic locking member 4 are blocked by the metallic shell 5 covers outside thereof for preventing them from moving overly.

The moveable locking arms 42 with arc-shaped smooth surface formed thereon are located outer than the contacts 2 for guiding the mating electrical connector 600 insertion and pulling out before the contacts 2 connects with the mating contacts 7. The inner round surface 103 of the mating space 101 are inclined for also guiding the mating electrical connector 600.

Figure 7:
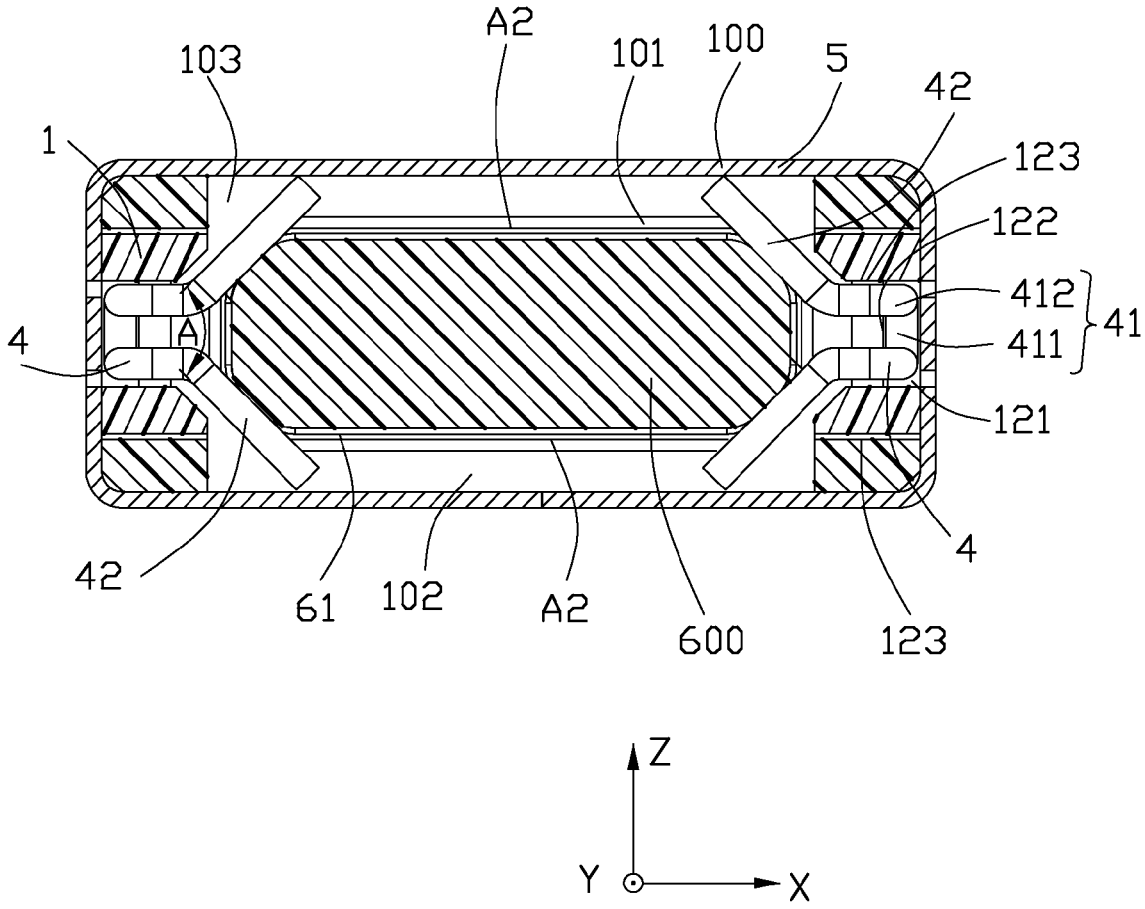
FIG. 7 is a cross-section view of the electrical connector assembly taken along line 7-7 of FIG. 2.
Figure 8:
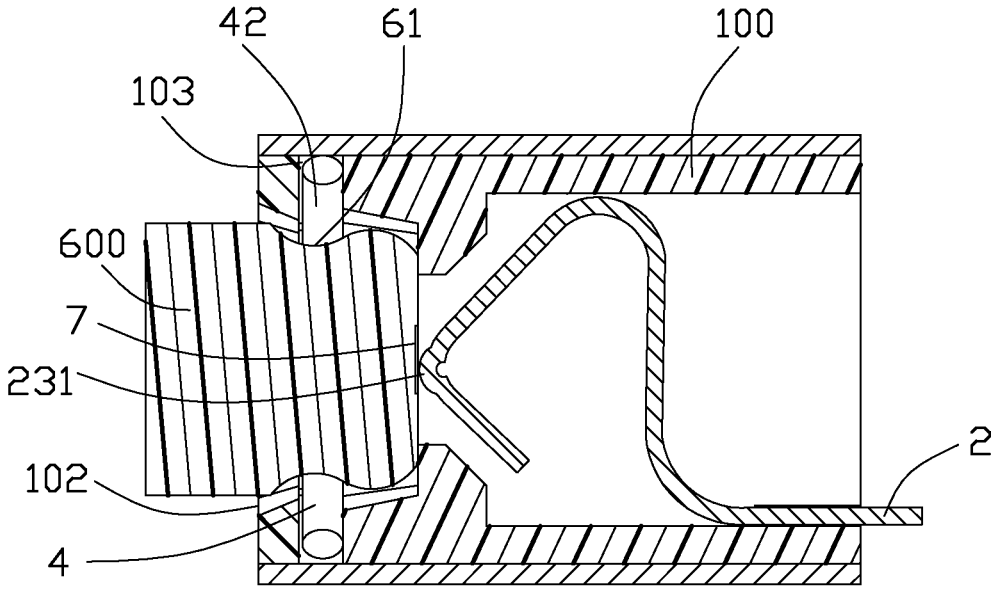
FIG. 8 is another cross-section view of the electrical connector assembly taken along line 8-8 of FIG. 2.

Referring to FIGS. 3, 6 and 7, the body portion 41 includes a U-shaped first portion 411 and two connecting portions 412 integrally connecting between the first portion 411 and the locking arm 42, thereby forming an L-shaped configuration, so as to receive in an L-shaped recess 121 at corner of the side wall 12 for decreasing space of the insulative housing 1 occupied by the locking member 4. So the body portion 41 is blocked by a bottom side 122 of the recess 121 for preventing thereof from movement in the X direction and hold by both inner sides 123 of the recess 121 in a vertical direction (shown as arrow Z).

In other embodiments, the insulative housing 1 also defines a mating island (not shown) extending in the mating space 101. The contacts 2 are pin shaped (not shown) and so on.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector with a mating surround interface for mating with a mating electrical connector, comprising:

an insulative housing comprising at least one side walls forming a mating space surrounded by the mating surround interface;

a plurality of contacts retained in the insulative housing and arranged along a longitudinal direction;

an elastic locking member mounted on the insulative housing; and a positioning spacer is mounted on the insulative housing;

wherein the electrical connector also comprises a receiving slit defined between the insulative housing and the positioning spacer for permitting movement of the elastic locking member therein, and the elastic locking member comprises a body portion mounted on the side wall and opposite to thereof and a pair of moveable locking arms integrally extending from both ends of the body portion which are bended to a different plane and extend through the mating surround interface.

2. The electrical connector as described in claim 1, wherein the body portion and the moveable locking arms of each elastic locking member forms an L-shaped configuration received in an L-shaped recess at corner of the side wall.

3. The electrical connector as described in claim 2, wherein the body portion is blocked by a bottom side of the recess for preventing thereof from movement in the longitudinal direction.

4. The electrical connector as described in claim 3, wherein the body portion is held by both inner sides of the recess in a vertical direction perpendicular to the longitudinal direction.

5. The electrical connector as described in claim 4, wherein the body portion includes a U-shaped first portion and two connecting portions integrally connecting between the first portion and the locking arm, thereby forming an L-shaped configuration.

6. The electrical connector as described in claim 4, wherein the positioning spacer comprises a tuber retained in a recess formed by the insulative housing.

7. The electrical connector as described in claim 2, wherein the mating space comprises an inserting opening for receipting the mating electrical connector inserted into thereof.

8. The electrical connector as described in claim 7, wherein the moveable locking arms of each elastic locking member are disposed round the mating space and partly protrude into the mating space for locking the mating electrical connector.

9. The electrical connector as described in claim 8, wherein the moveable locking arm moves clockwise or counterclockwise, thereby forming a variable angle A which is open to the mating space.

10. An electrical connector assembly, comprising:

an electrical connector comprises an insulative housing with at least one side walls, a plurality of contacts arranged in the insulative housing along a longitudinal direction and an elastic locking member mounted on the insulative housing and defines a first mating surround interface; and a mating electrical connector with a second mating surround interface for engaging with the first mating surround interface in a mating direction perpendicular to the longitudinal direction;

wherein the elastic locking member comprises a body portion mounted on the side wall and a pair of moveable locking arms integrally extending from both ends of the body portion and bended to a different plane, and the body portion engages with the side wall when the electrical connector and the mating electrical connector disengages with each other.

11. The electrical connector assembly as described in claim 10, wherein when the mating electrical connector engages with the electrical connector, the locking arms move to a second position in which the locking arm is urged and moves into a receiving slit formed between the insulative housing and a positioning spacer mounted on the insulative housing for permitting movement of the elastic locking member therein in a vertical plane perpendicular to the mating direction for permitting the mating electrical connector easily insertion, from a first position in which the locking arm is in original state partly protruded into the mating space from the receiving slit.

12. The electrical connector assembly as described in claim 11, wherein after the electrical connector assembly is engaged together, the locking arms return to the original state and lock in a recess area of the mating electrical connector for stably locking the electrical connector assembly together.

13. The electrical connector assembly as described in claim 11, wherein the electrical connector comprises a metallic shell blocking and covering outside of the elastic locking member.

14. The electrical connector assembly as described in claim 11, wherein the moveable locking arms with arc-shaped smooth surface formed thereon are located outer than the contacts.

15. An electrical connector assembly comprising:

an insulative housing defining a mating face and a mating direction perpendicular to said mating face;

a plurality of contacts disposed in the housing with deflectable contacting sections exposed beyond the mating face, said contacting sections being backwardly moveable along the mating direction during mating;

an elastic locking member associated with the housing and defining a locking arm deflectable in a plane parallel to said mating face for being locked, along the mating direction, into a groove of a complementary connector which pushes the contacting sections backward in the mating direction during mating;

wherein the locking member further includes a body extending along a mating direction so as to cooperate with the locking arm to form an L-shaped configuration.

16. The electrical connector assembly as claimed in claim 15, wherein the housing defines a mating space in front of the mating face, and the locking arm is located in front of the mating space.

17. The electrical connector assembly as claimed in claim 15, wherein the mating space defines chamfered structures on corners, and the locking arm complies with said chamfered structures in the mating direction.

18. The electrical connector assembly as claimed in claim 15, further including a positioning spacer in front of the mating space to cooperate with the housing to sandwich the locking member therebetween in the mating direction.

19. The electrical connector assembly as claimed in claim 18, further including a metallic shell to grasp the housing and the positioning spacer to fasten the positioning spacer to the housing.

* * * * *